US006205587B1

(12) United States Patent
Shiffler

(10) Patent No.: US 6,205,587 B1
(45) Date of Patent: Mar. 27, 2001

(54) NECKTIE

(76) Inventor: Joel D. Shiffler, 2063 Tunisia Ave., Spring Hill, FL (US) 34609

( * ) Notice: Subject to any disclaimer, the term of this patent is extended or adjusted under 35 U.S.C. 154(b) by 0 days.

(21) Appl. No.: 09/310,590

(22) Filed: May 12, 1999

Related U.S. Application Data

(60) Provisional application No. 60/085,785, filed on May 18, 1998.

(51) Int. Cl.[7] ..... A41D 25/06

(52) U.S. Cl. ..... 2/146; 2/146; 2/155; 2/144

(58) Field of Search ..... 2/146, 144, 145, 2/150, 153, 156, 152.1

(56) References Cited

U.S. PATENT DOCUMENTS

| | | |
|---|---|---|
| D. 239,577 | 4/1976 | Slocum . |
| 2,694,203 | 11/1954 | Sanford . |
| 2,825,904 | 3/1958 | Klaus . |
| 2,893,013 | 7/1959 | Miller . |
| 3,358,291 | 12/1967 | Davidowitz et al. . |
| 3,950,790 | 4/1976 | Adler . |
| 3,959,825 | 6/1976 | Hughes . |
| 5,142,703 | 9/1992 | Basinger et al. . |

*Primary Examiner*—John J. Calvert
*Assistant Examiner*—Tejash Patel
(74) *Attorney, Agent, or Firm*—Reising, Ethington, Barnes, Kisselle, Learman & McCulloch, PC

(57) ABSTRACT

A reversible dual necktie and method of constructing the same wherein, in one preferred embodiment, complete single four-in-hand type first and second neckties are provided with releasable and cooperable first and second fasteners attached to tie posterior sides of said ties in predetermined locations coordinated for inter-coupling cooperation. The ties are releasably assembled together by juxtaposing the posterior sides of the two ties in mutually facing relation with the fasteners mutually registered and then inter-coupling the fasteners to thereby provide a dual reversible necktie. Preferably the orientation of the fastener predetermined locations is such that the ties upon being so coupled are thereby aligned in laterally staggered off-set relationship such that only one longitudinal edge of the posterior surface of the second tie is exposed to view by a frontal observer of the tie user-wear, and such second tie edge appears along the adjacent longitudinal edge of the first tie when the dual necktie is worn with the first tie outermost, and vice versa upon reversal.

34 Claims, 6 Drawing Sheets

REVERSIBILITY STITCHING

NON-REVERSIBLE STITCHING

NEEDLE GOES DOWN INTO BACK OF ANTERIOR TIE

NECKTIE

This is a United States regular utility patent application filed pursuant to 35 U.S.C. §111(a) and claiming the benefit under 35 U.S.C. §119(e)(1) of the priority of U.S. Provisional Patent Application Ser. No. 60/085,785 filed May 18, 1998 pursuant to the provisions of 35 U.S.C. §111(b).

FIELD OF THE INVENTION

This invention relates to neckties of the four-in-hand type and relates more particularly to a novel dual necktie construction which enables the economical production of new necktie designs from conventional and completed four-in-hand type neckties.

BACKGROUND OF THE INVENTION

Conventional four-in-hand neckties are typically constructed with an outer layer Of base fabric, usually woven, and of a uniform pattern and/or color throughout. Hence a substantial inventory of different designs and patterns of such ties is typically required to meet the wardrobe needs of the average necktie wearer for matching or harmonizing with the wearing apparel selected for the day or the occasion. Moreover, the range of variations in the ornamental styling and aesthetic effect presented by such ties is limited by the conventional construction of such ties.

In the prior art several efforts have been made to enhance the versatility of the wearer's wardrobe inventory of neckties by special constructions produced at the point of tie manufacture to provide, for example, a reversible necktie, such as that shown in the Hughes U.S. Pat. No. 3,959,825. Further efforts have been made in the past to provide novel necktie constructions which enable the production of new necktie designs theretofore unobtainable with then known methods of making neckties. Special contrasting border effects have been achieved in the constructions of the Adler U.S. Pat. No. 3,950,790 and Klaus U.S. Pat. No. 2,825,904. However these special-effect neckties constructions were designed only for practical implementation at the point of tie manufacture and required deviation from standard production methods for making conventional four-in-hand ties. The additional costs involved have undoubtedly prevented these ties constructions from appearing in the market place in other than very limited quantities, if at all.

Another example of such patent efforts is shown in U.S. Slocum design Pat. Des. 239,577 illustrating a dual necktie construction in which an outer or front tie, apparently of somewhat conventional construction, overlies an inner or rear tie, also apparently of conventional construction. The inner tie is wider than the outer or front tie, the outer tie being substantially narrower so that the posterior or exterior surface of the inner or rear tie is only visible along both of its longitudinal edges where the same is not covered by the front tie. However this tie construction is not conventional in that the ties are not four-in-hand ties, but rather are cut-off so as to only present a front length portion of each tie. The upper ends are attached in some fashion to a specially constructed neck band with a rearwardly positioned detachable fastener construction, somewhat in the manner of pre-tied "cheater" bow ties. The Slocum design also is neither reversible in use nor constructable from standard four-in-hand neckties of conventional widths, which typically in men's neck wear only gradually vary in width with gradual style changes over the years.

OBJECTS OF THE INVENTION

Accordingly, among the objects of the present invention are to provide a new and improved dual necktie construction and method of making and using the same wherein the dual tie is readily fabricated from ready-made conventional four-in-hand neckties of woven and/or knit construction, which is capable of presenting a novel aesthetic design effect by presenting a dual tie array in the form of an inner tie providing a border trim along one edge of a fully visible outer tie of the dual tie and that is of contrasting color, texture, fabric and/or pattern to harmonize or accent the main color, texture, fabric, pattern and/or design effect of the outermost tie of the dual tie array.

Another object of the present invention is to provide a novel dual tie construction, and method of making and using the same, of the aforementioned character which may be assembled and disassembled by the user for conversion to four-in-hand single necktie use of each of the neckties of the dual necktie array, thereby doubling the potential number of single neckties available for wear as such in the wearer's wardrobe of ties, and by mixing and matching, exponentially increasing the combinations of dual neckties available from a given wardrobe of such dual neckties.

A further object is to provide an improved dual necktie of the aforementioned character which is reversible to present a clean side of the necktie when the first side worn becomes soiled through normal use or by food spill accidents.

Yet another object is to provide improved dual necktie construction of the aforementioned character which provides a reversible necktie of symmetric construction in order that either of the two sides may be worn outward with equal ease and sartorial splendor and a different but complimentary styling presented by such reversal.

BRIEF DESCRIPTION OF THE DRAWINGS

Other objects as well as features and advantages of the present invention will become apparent from the following detailed description taken in conjunction with the appendix of disclosure materials accompanying the aforementioned provisional application (incorporated herein by reference), as well as from the accompanying application drawings wherein.

DETAILED DESCRIPTION OF PREFERRED EMBODIMENTS

First Embodiment

Figure 1:
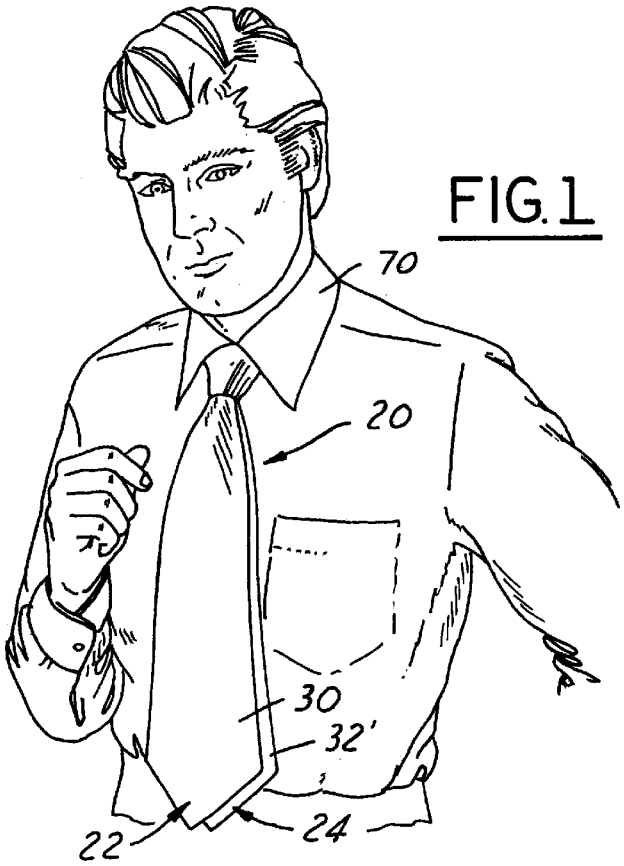
FIG. 1 is a perspective view of a first embodiment of a reversible and separable dual necktie construction of the invention, illustrated as it is worn with a conventional wing collar shirt.
Figure 3:
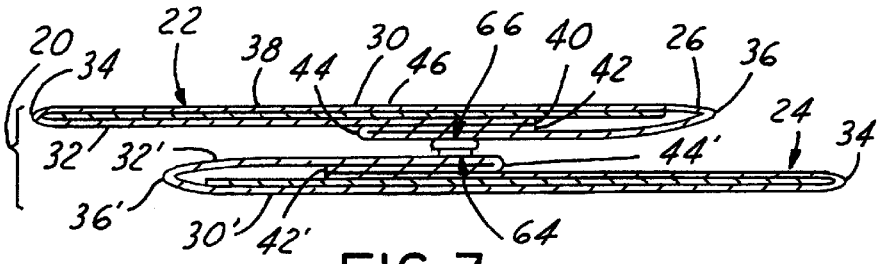
FIG. 3 is a cross-sectional view taken on the line 3—3 of FIG. 2.
Figure 2:
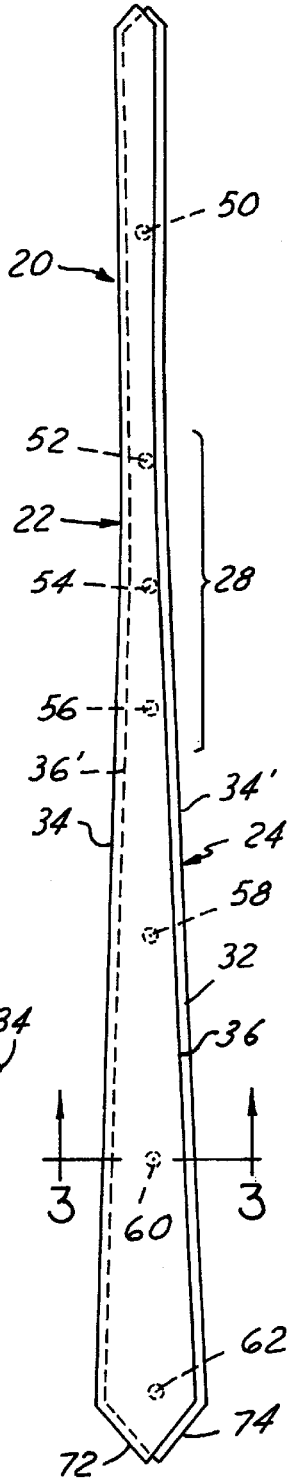
FIG. 2 is a plan view of the dual necktie of FIG. 1.

Referring in more detail to the accompanying application drawings, FIGS. 1, 2 and 3 illustrate a first embodiment of a dual necktie 20 constructed in accordance with the present invention. Necktie 20 is preferably made from two conventionally manufactured four-in-hand separate and complete neckties 22 and 24 assembled in accordance with the invention to provide a dual necktie construction capable of achieving one or more of the aforementioned objects of the invention. Each of the neckties 22 and 24 is preferably a ready-made necktie available as an off-the-shelf item from necktie manufactures, wholesalers, distributors and/or retailers.

Thus, as shown, the nominally outer or anterior necktie 22 thus is constructed with of an outer layer of a base fabric 26 that may be formed from a single blank, or that may be formed from two blanks joined together by a diagonal stitch line (not shown) at the center of the neck-encircling section 28 (FIG. 2) of dual tie 20. Examples of manufacturing four-in-hand conventional necktie constructions are set forth in U.S. Pat. Nos. Miller 2,893,013 and Davidowitz et al 3,358,291, both of which are incorporated herein by reference. As completed, the base fabric 26 is folded back upon itself to form the usual outer (anterior) face 30 and inner (posterior) face 32, with the main tapering longitudinal side edges 34 and 36 of tie 22 typically being pressed to a sharp edge in a finishing operation in the manufacture of tie 22. A suitable piece of liner material 38 is typically enclosed between the outer face 30 and inner face 32 to add stiffness, body and an appropriate "lay" or "feel" to the tie construction. One longitudinal side edge 40 of the base fabric blank lays directly against the interior side of liner 38 and terminates spaced inwardly from the fold edge 36 of the tie. The other longitudinal edge 42 of the base blank fabric is arranged flush with edge 40. Blank edge 42 is folded back upon itself at the fold 44 to provide a double thickness hem section which is permanently joined by a line of stitching 46 adjacent the fold 44 to the overlapped edge 40 of the under lying portion of the rear face 32 of the base fabric.

The inner or posterior tie 24 of the dual tie construction 20 may be of conventional single four-in-hand tie construction identical to tie 22, but is assembled in reversed relationship to outer tie 22, as best seen in FIG. 3. Hence corresponding structural elements of inner tie 24 are given the same reference numeral as like elements of tie 22 raised by a prime suffix, and their description not repeated.

As shown in FIGS. 2 and 3, outer tie 22 and inner tie 24 of the dual tie construction 20 are detachably secured to one another by a row of conventional snap fasteners 50, 52, 54, 56, 58, 60 and 62 suitably spaced from one another as indicated in FIG. 2. Each of the snap fasteners 50–62 consist of a conventional male snap element 64 and cooperative female snap element 66 as shown in FIG. 3. By way of example, the male snap element 64 is attached to the posterior surface 32' of tie 24 adjacent fold 44', as by stitching. The female snap element 66 is attached to the posterior surface 32 of tie 22, also as by suitable stitching, and generally laterally centered between fold 44 in the blank edges 40, 42.

When the male and female elements 64 and 66 of snap fasteners 50–62 are snapped engaged together the outer tie 22 will necessarily overlie inner tie 24 in the manner shown in FIGS. 1, 2 and 3. That is, the positioning of the snap fastener elements 64 and 66 on their respective ties will automatically align the ties 22 and 24 in laterally staggered off-set relationship with the right hand (as viewed in FIGS. 1–3) longitudinal edge of posterior surface 32' of inner tie 24 exposed as a border strip along the right hand edge of outer tie 22 for the full length of these respective ties. It will be noted that the respective "non-dress" sides 32 and 32' of the two ties 22 and 24 of the dual tie 20 face each other when the two ties are snap fastened together. Also, when the two ties 22 and 24 are of equal length and of standard four-in-hand construction as shown, a double pointed appearance is presented at each of the longitudinally opposite ends of the tie (FIG. 2) the adjacent tie tips of each end being generally flush with one another.

It is also to be noted that the portion of the posterior surface 32' of the inner tie 24 exposed to view beyond the longitudinal side edge 36 of outer tie 22 is only a small percentage of the total width of inner tie 24. In the first embodiment this remains true throughout the entire longitudinal extent of the dual tie 20. For example, assuming the transverse width of ties 22 and 24 at the section line 3—3 of FIG. 2 to be about 3½ inches, the off-set distance between the side edge 36 of tie 22 and the corresponding side edge 34' of tie 24 is approximately zero to five-eighths of an inch. Typically, in most conventional four-in-hand tie constructions, exposing only this much of the non-dress posterior surface 32' of the tie maintains the manufacturer's label and the central hem stitching region hidden from view. Hence the exposed border of the inner tie between the side edges 36 and 34' as viewed by an observer facing the wearer of the tie appears to be a portion of the dress-side, i.e., anterior surface, of an underlying separate tie. Of course, the snap fasteners 50–62 are likewise concealed between the inner and outer ties and thereby hidden from ordinary view.

Hence the dual tie 20 after being trained beneath the shirt collar 70, tied with the four-in-hand knot and then the collar turned down as shown in FIG. 1, will present a full dress dual-tie appearance.

The choice of color, pattern, texture and/or fabric employed in the construction of each individual tie 22 and 24 of the dual tie 20 is limited only by the imagination by the stylist or tie designer. For example, outer tie 22 may be a conventional regimental rep stripe tie with diagonal regimental stripe pattern, whereas inner tie 24 may be a tie made of a solid color fabric harmonizing with the multiple colors of the rep stripe pattern. Conversely, outer tie 22 may be a solid color and inner tie 24 a checked herringbone or variegated pattern of suitable matching or harmonizing color. The capability thereby provided to choose a combination of pattern versus plain, different tie colors, etc. for the respective inner and outer ties thus provides the designer almost unlimited choices to create a very interesting and pleasing border effect in a dual tie wherein the appearance of outer tie 22 enhances that of inner tie 24, and vice versa.

It will also be seen that the "back-to-back" detachable fastening of the inner and outer ties 22 and 24 renders dual tie 20 a reversible tie. That is, merely by flipping over dual tie 20 when removed from the wearer and then retying it now presents the posterior or dress side 30' of what was formerly the inner tie 24 as the main exterior or anterior dress surface of dual tie 20. When the inner and outer ties are of equal transverse width, as shown in FIG. 2, or at least so dimensioned in the portion between the lower end of the neck or collar zone 28 and the bottom tips 72 and 74 of the larger width portions of ties 22 and 24 (as taken in transverse section along any point in the length of at least this portion of the tie), the width of the exposed margin of what is now inner tie 22 (i.e., the portion between inner tie edge 34 and now outer tie edge 36') remains the same as before reversal, and hence the width of the contrasting border when tie 20 is reversed remains the same. Of course the aesthetic effect of dual tie 20 when so reversed is also reversed, thereby presenting an entirely new appearance but still color-coordinated or pattern-coordinated as initially determined for dual tie 20 when tie 22 is to be normally the outer tie.

Due to the detachable fastening of tie 22 to tie 24 in dual tie 20 the two individual ties, that when assembled make up dual tie 20, can be readily separated and worn separately with their respective fastening implements hidden on the posterior, non-dress side of each such single tie. Since each of ties 22 and 24 is constructed as a single and complete conventional four-in-hand tie, when either tie is worn separately it will have the appearance of a conventional four-in-hand tie, and of course will have all the constructional features of an ordinary conventional four-in-hand tie. Hence the purchaser of one dual tie 20 in essence is buying the capability of four different ties: (1) dual tie 20 worn as shown in FIG. 1 with tie 22 being the outer tie; (2) the reversal described above wherein the tie is flipped over and inner tie 24 becomes the outer tie and outer tie 22 becomes the inner tie in a reversed dual tie array; (3) outer tie 22 worn separately by itself; and (4) inner tie 24 worn separately by itself.

Moreover, when the tie purchaser has acquired a wardrobe of four different dual ties 20, each individually differing from the rest in style color, pattern, texture and/or fabric, and with all the ties constructed dimensionally the same and with the releasable fasteners as described above, the number of potential single ties becomes eight and the number of dual tie combinations becomes anywhere from four ties, if fasteners are centrally located, or thirty-two if there is an edge 34' of tie 24 on the type of tie purchase. The economic advantages to the user thus becomes readily apparent, and geometrically progresses as the number of different dual tie combinations acquired in the tie wardrobe increases.

Second Embodiment

Figure 4:
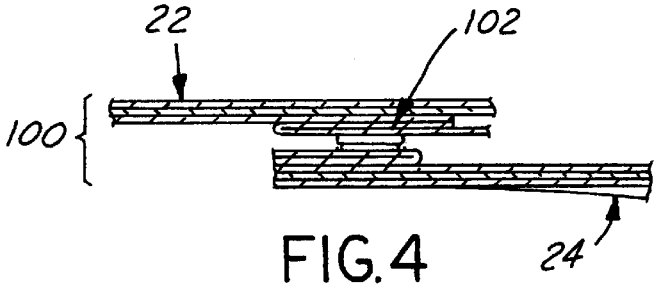
FIG. 4 is a fragmentary cross-sectional view taken at a location similar to that of FIG. 3, but illustrating a second embodiment dual tie construction of the invention.

The second embodiment dual tie 100 illustrated in FIG. 4 is identical to dual tie 20 except for the nature of the detachable fasteners. Instead of snap fasteners, hook and loop type (Velcro®) sets of fasteners 102 are substituted for each of the snap fastener sets 50–62 and mounted in like locations. The hook material portion of each fastener set 102 is adhesively secured to one of the ties 22, 24, and the loop material portion of the fastener set 102 is adhesively attached to the other of the ties 22, 24. Alternatively, these hook and loop fasteners may be attached by stitching to the material of the associated tie. Dual tie 100 thus has all the operational user advantages of tie 20 as enhanced by the ease of use and economy of hook and loop type fasteners.

It will now be appreciated from the foregoing description that the dual ties 20 and 100 can be readily made at essentially the cost of two separate ties 22 and 24, with the fasteners 50–62 (or 102) adding very little cost to the total dual tie package. Since each of the ties 22 and 24 of the dual tie 20 or 100 can be worn separately, the overall cost of the tie wardrobe has not been materially increased over a corresponding single tie wardrobe. Yet the variety of ties in the wardrobe has been greatly expanded, and potential variations in designs and styles now possible likewise greatly expanded.

Additionally, because of the ease of properly attaching the hook and loop type fasteners 102 to conventional tie, a "do-it-yourself" instruction kit providing only fastener materials 50–62 or 102 alone may be provided to the market (with a suitable instruction sheet) in order to enable those having existing tie wardrobes made up solely of single four-in-hand ties to easily and economically convert the same to dual ties in accordance with the invention. The design combinations will then be limited only by the kit customer's existing tie inventory and his imagination. This retrofit capability thus allows an existing tie wardrobe to be greatly expanded and unusual dual tie effects created inexpensively with the purchase of a suitable number of fastener conversion kits. It is thus to be understood that this method and kit means for converting existing conventional four-in-hand single ties into dual ties in accordance with the invention is also considered to be within the scope of the present invention.

Third Embodiment

Figure 5:
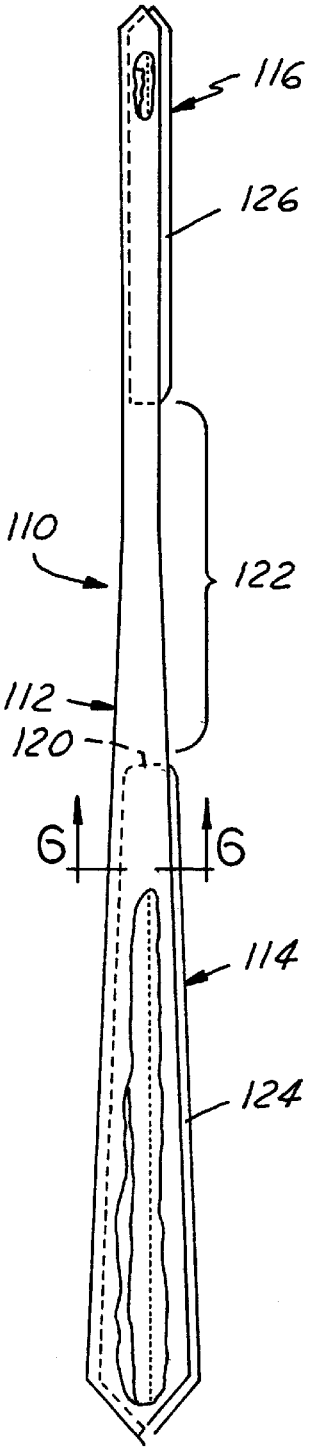
FIG. 5 is a plan view of a third embodiment dual necktie construction of the invention, with portions broken away to illustrate detail.
Figure 6:
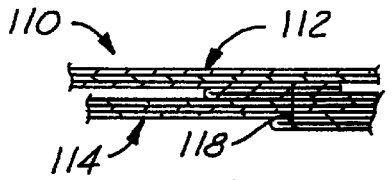
FIG. 6 is a fragmentary cross-sectional view taken on the line 6—6 of FIG. 5.

FIGS. 5 and 6 illustrate a third embodiment of the dual tie construction 110 also in accordance with the present invention. Dual tie 110 of FIGS. 5 and 6 consists of a conventional four-in-hand outer tie 112 having two inner tie sections 114 and 116 each permanently attached to tie 112 as by a line of stitching 118 through mid-sections wherein the number of plies of material is maximum (FIG. 6). Inner tie section 114 is again constructed in the manner of a conventional four-in-hand tie but preferably is terminated at its upper end 120 at the adjacent end of the collar zone 122 of tie 110. The width of inner tie section 114 and its angle of taper preferably matches that of the corresponding coextensive length of outer tie 112. Likewise, the amount of lateral stagger or off-set of the inner and outer ties 114 and 112 is established to create the visible border 124 of tie section 114, similar to the border offset in dual ties 20 and 100). Similarly, the narrower width tie-section 116 of the inner tie is made matching in width and taper to the coextensive length of the associated narrower portion of outer tie 112 and permanently stitch-attached thereto in like manner in offset relation to present the visible border 126.

In the example illustrated in FIGS. 5 and 6 dual tie 110 is not intended to be reversible inasmuch as the non-dress sides of inner tie sections 114 and 116 are presented at the posterior surface of the dual tie 110 and hence would be undesirably visible upon flipping the tie over in reversal mode unless upper end of tie section 114 is hidden in the knot of the tie. When so constructed as a non-reversible and non-convertible dual tie 110, the outer tie 112 as well as inner tie sections 1 14 and 116 may, if so desired by the tie manufacturer, be made merely by folding over the respective base fabrics without the use of a lining 38 since such a dual tie already has enough bulk for proper lay and feel. Indeed only a single layer of base fabric with narrow fold-under material can be used to make tie 112 and sections 114 and 116. Providing the inner tie in the form of two separate sections 114 and 116 separated by the neck span 122 also saves material and reduces the bulk of the dual tie 110 where it is entrained beneath the shirt collar 70 of the wearer.

Of course it is to be understood that dual tie 110 also can be made as a reversible tie by attaching inner tie sections 114 and 116 with their posterior, non-dress surfaces facing the posterior, non-dress surface of the outer tie 112. In this event the spacing between the mutually juxtaposed terminal ends of sections 114 and 116 defining the neck portion 122 may be made slightly smaller so that these ends remain hidden beneath collar 70 when the tie is worn by the user. In addition, dual tie 110 also may be made convertible by providing detachable fasteners between the inner tie sections 114 and 116 and the associated portions of the outer tie 112 so that sections 114 and 116 can be removed from outer tie 112 and then outer tie 112 worn separately as a single tie, when so desired.

Fourth Embodiment

Figure 7:
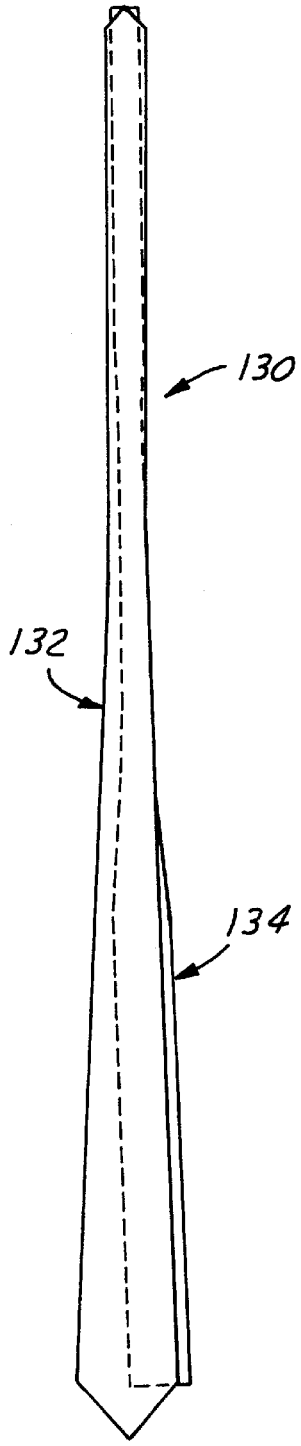
FIG. 7 is a plan view of a fourth embodiment necktie construction of the present invention.

A fourth embodiment dual tie 130 is shown in FIG. 7 also constructed in accordance with the present invention. Dual tie 130 consists of a conventional single complete four-in-hand outer tie 132 in which the base fabric is preferably woven and may have a rep stripe or other pattern (not shown), whereas inner tie 134 is of conventional tubular knit construction and is removably attached to outer tie 132 with its posterior surface facing that of tie 132 in the manner of attachment utilized in dual tie 20 or 100 described previously (and hence not shown in FIG. 7). Preferably knit tie 134 is of solid color and selected to harmonize with the multi-color pattern of the woven 10 material pattern tie 132. An example of this construction is shown in the color photoprints Nos. 1–5 in the Appendix attached to the aforesaid provisional application, and incorporated herein by reference. Due to the typically narrower width and different geometry of the conventional tubular knit tie 134 compared to that of the conventional woven fabric outer tie 132, inner tie 134 does not sufficiently cover the material of the posterior surface of outer tie 132 in order to render the dual tie 130 reversible. However the inner and outer ties of this dual tie may be separated and used as separate single ties separately since the posterior-side fastenings on each of the ties will be hidden on the posterior surface of each tie as worn. If desired the location of the row fasteners 50-62 of the inner tie 134 may be offset skewed so as to be aligned with the fasteners on the exterior tie 132 when the same are arrayed as in FIG. 2 so that outer tie 132 remains usable with other four-in-hand ties 22, 24 etc. in convertible and reversible dual tie array assemblies therewith.

Fifth Embodiment

Figure 9:
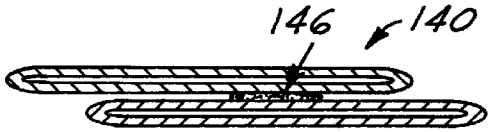
FIG. 9 i s a cross-sectional view taken on the line 9—9 of FIG. 8.
Figure 8:
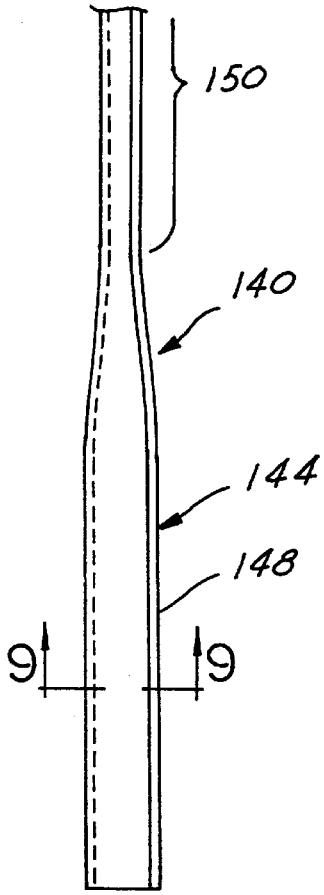
FIG. 8 is a fragmentary plan view of a fifth embodiment necktie construction of the invention.

FIGS. 8 and 9 illustrate a fifth embodiment dual tie construction 140 also in accordance with the invention. Dual tie 140 consists of an outer tie 142 and inner tie 144 assembled in overlapping, laterally staggered off-set relationship in the manner of the first and second embodiments. However, in this embodiment each of the inner and outer ties 142 and 144 is constructed as a conventional complete tubular knit tie, usually of all solid color and without liner. These knit ties are detachably secured together by a spaced row of preferably hook and loop type, posterior side fastener sets 146 (FIG. 9) in the manner of hook and loop fasteners 102 of FIG. 4. Dual tie 140 thus is separable into two individual ties each wearable separately as double knit ties, and when assembled together into a dual tie 140 can be reversed to present an opposite design effect. That is, if outer tie 142 is black and inner tie 144 is red, then when worn as shown in FIG. 8 dual tie 140 will appear primarily as a black knit tie with a red knit border 148. When worn reversed as a dual tie the opposite effect will appear, namely a red knit tie with a black border.

Again, dual tie 140 can be readily constructed in accordance with the invention with a "do-it-yourself" fastener kit so that an existing wardrobe of knit ties can be retro fitted to convert the same to dual ties without thereby destroying their use as single ties. Likewise the potential number of combinations of dual knit ties is limited only by the variety of knit ties in the existing wardrobe. Since knit ties conventionally do not have liners and are less bulky in their thickness dimension, the double thickness in the area of overlap of the two ties in the neck or collar region 150 can be readily accommodated beneath collars narrower than the standard collar 70 (preferably button-down type) of the conventional shirt without discomfort or noticeably altering the exterior appearance of the narrower collar. However, even with the double thickness of two complete ties in the collar region of ties 20, 100 and 130, most currently popular styles and makes of shirt collars will accommodate the double tie thickness without noticeable alteration of the collar appearance.

Sixth Embodiment

Figure 10:
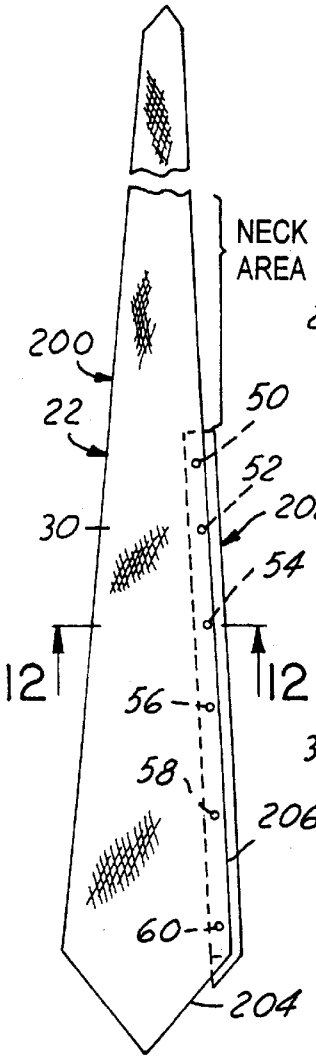
FIG. 10 is a simplified plan view of a sixth embodiment necktie construction of the invention.
Figure 12:
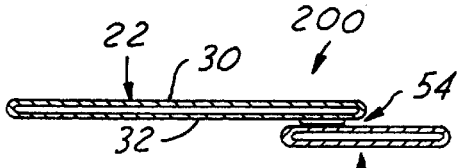
FIG. 12 is a cross-sectional view taken on the line 12—12 of FIG. 10.

FIGS. 10 and 12 illustrate a sixth embodiment dual tie construction 200 in which the front or anterior tie 22 may be constructed identical to that of the first embodiment dual tie construction 20. Tie 22 is provided with the female snap elements 66 for the snap fastener sets 50–60 in the manner of tie 20 for detachable fastening to a "port" side "mini-tie" 202 constructed as shown in FIGS. 10 and 12. Approximately half of the lateral width of mini-tie 202 underlies the posterior side of tie 22 along the port side edge (the right hand edge of tie 22 as viewed from a frontal observer of the tie wearer) and has a length designed only to extend from diagonal lower edge 204 of tie 22, at its junction with its port side edge 206, up to the vicinity but short of the neck or collar area of tie 200.

Figure 11:
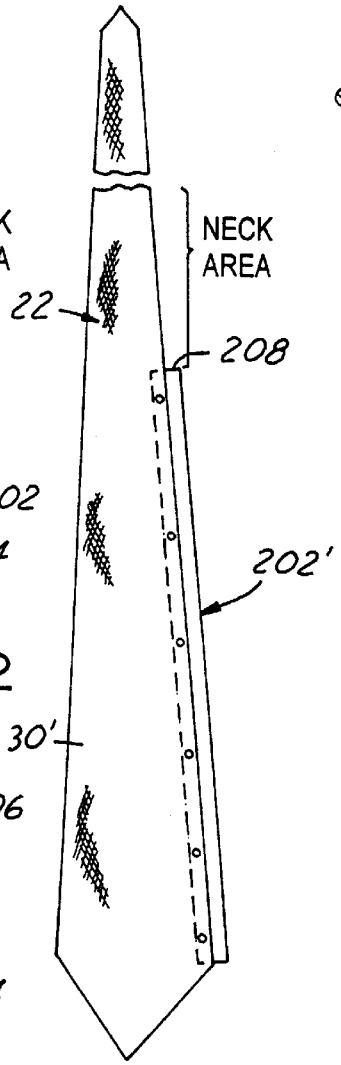
FIG. 11 is a view similar to FIG. 10 of a modification of the sixth embodiment of FIG. 10.

The modification of FIG. 11 merely illustrates the application of a longer "mini-tie" 202' to tie 22 such that the upper terminal edge 208 of mini-tie 202' is disposed closer to the neck area of tie 22 when attached thereto.

Figure 13:
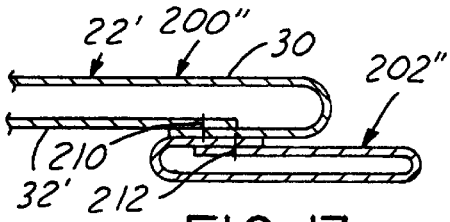
FIG. 13 is a fragmentary cross-sectional view of a modification of FIGS. 10–12.

FIG. 13 illustrates a further modification 200" of a dual necktie construction similar to that of FIGS. 10–12 but wherein a main tie 22' is attached to a mini-tie 202" by two lines of laterally offset stitching 210 and 212 to render the dual tie construction 200" permanent as to the attachment of the mini-tie 202". The dual ties 200, 202' and 202" are generally not considered to be reversible ties. Rather, they are generally intended to be an economical construction for achieving the "dual tie look" once the same has become popularized by successful commercialization of the first five embodiments described hereinabove. However, dual ties 200, and 202" may be reversed if desired with the respectively associated mini-tie 202, 202', 202" becoming the anterior of the two ties.

Seventh Embodiment

Figure 15:
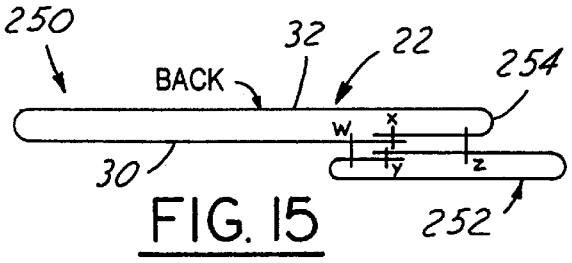
FIG. 15 is a simplified cross-sectional view taken on the line 15—15 of FIG. 14.
Figure 14:
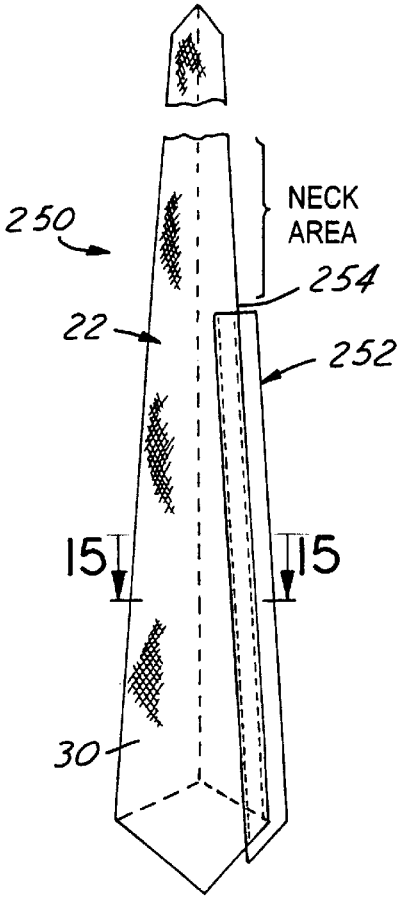
FIG. 14 is a simplified plan view of a seventh embodiment necktie construction of the invention.

FIGS. 14 and 15 illustrate a seventh embodiment dual tie construction 250 in which the main tie 22 is identical to that of the first embodiment tie 20 in initial construction. A "mini-tie" 252 constructed similar to mini-ties 202, 202' or 202" is attached to the anterior surface 30 of main tie 22, instead of to its posterior surface 32 so as to lap over one of the two longitudinal side edges of the tie, namely the port side edge 254 of tie 22 as shown in FIGS. 14 and 15. Approximately half the lateral width of mini-tie 252 overlaps the side edge portion of tie 22 and half of its lateral width extends laterally therebeyond. Mini-tie 252 may be attached by three lines of stitching indicated at W,X-Y and Z in FIG. 15 to provide a permanent attachment of mini-tie 252 to tie 22. Alternatively, detachable attachments can be provided in accordance with the previously described snap fastener or "Velcro" type attachment systems of the previously described embodiments. Again, the upper end of mini-tie 252 may be designed to terminate just short of the neck area of tie 22 and hence be hidden under the shirt collar when worn by the wearer of tie 250.

Eighth Embodiment

Figure 16:
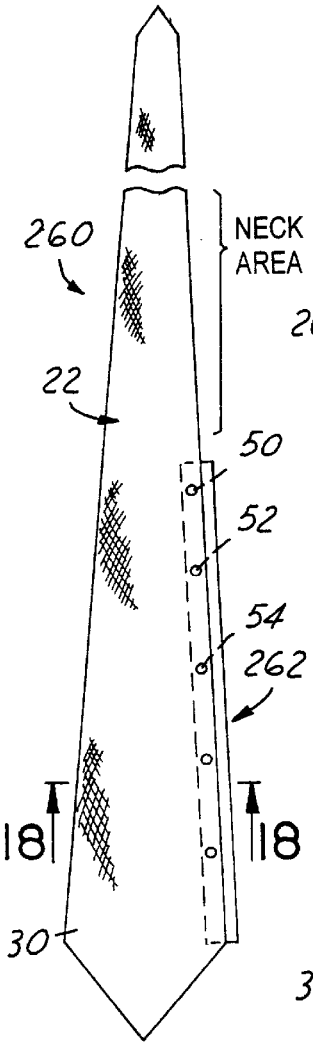
FIG. 16 is a simplified plan view of an eighth embodiment necktie construction of the invention.
Figure 17:
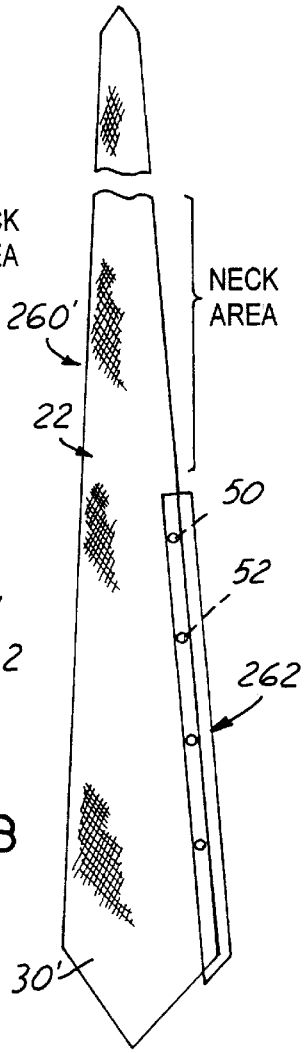
FIG. 17 is a simplified plan view of a modification of the construction in FIG. 16.
Figure 18:
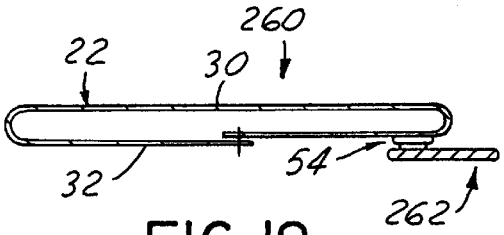
FIG. 18 is a simplified cross-sectional view taken on a line 18—18 of FIG. 16.

FIGS. 16 and 18 illustrate an eighth embodiment dual necktie construction of the invention wherein the mini-tie 202, 202' or 202" is replaced by an elongated flat planar monolayer strip, preferably made of plastic material and given a color or other aesthetic finish either harmonizing or suitably contrasting with that of tie 22 of the dual tie 260. Plastic strip 262 may be attached removably to the posterior surface 32 of tie 22 by the previously described snap fasteners 50, 52, 54 etc. Setup 262 is preferably is designed as a simple means of replicating the appearance of the ties of the first five embodiments at less expense than the mini-ties of the sixth embodiment and the modification thereof of FIGS. 10–13. The modified dual tie construction 260' of FIG. 17 is likewise intended as a substitute for tie 250 of FIGS. 14 and 15 by providing a decorative plastic strip 262' removably attached to the anterior surface 30 of tie 22 of the dual tie construction 260'. Again, preferably the upper end of strips 262 and 262' are designed to be terminated adjacent the neck area of tie 22 so as to be hidden in use beneath the shirt collar of the tie wearer or when the upper ends of strips 262, 262', and the like mini-ties 252, 202, 202' and tie section 114, are hidden in the knot of tie at the neck..

Stitching Illustrations

FIGS. 19–22 illustrate in sequence by way of an exemplary diagrammatic hand stitching fastening mode with a needle and thread one manner of providing stitching of the anterior tie to the posterior tie when designed for a dual necktie construction that is reversible, i.e. that can be worn with either the anterior or posterior tie facing outward.

Likewise, FIGS. 23–28 illustrate in sequence steps an exemplary manual stitching fastening mode, with a needle and thread, the anterior and posterior ties of applicant's dual necktie construction embodiments where the dual tie construction is not intended for reversible use.

FIGS. 19–28 are not given reference numerals nor further described since they are believed to be self-explanatory from their respective diagrammatic showings.

Ninth Embodiment

Figure 29:
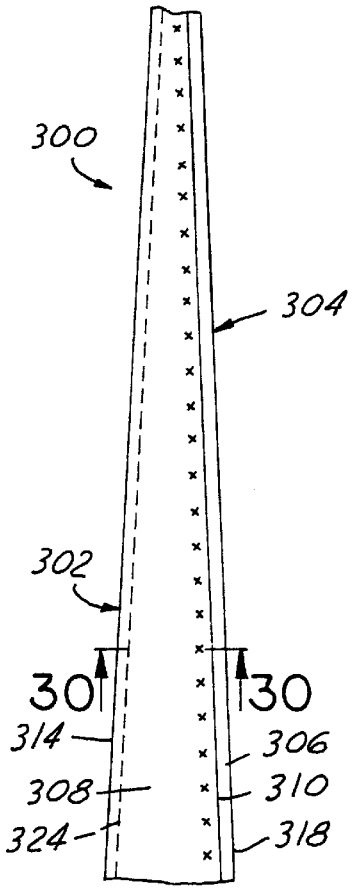
FIG. 29 is a simplified plan view of a ninth embodiment necktie construction of the invention.

FIGS. 29–34 illustrate a ninth embodiment dual necktie construction of the invention and an exemplary method of constructing same. As shown in FIG. 29 the dual necktie 300 of the ninth embodiment construction can provide an appearance similar to the fifth embodiment construction of FIGS. 8 and 9 but is not made up of two separate complete neckties. Instead, necktie 300 is constructed from two layers of diverse fabric materials that are laminated so as to be edgewise co-terminus with one another. Thus, tie 300 as shown in FIG. 29 presents what appears to be a complete anterior tie 302 having protruding laterally along its port side longitudinal edge 3 10 thereof a portion 306 of a posterior tie 304 protruding edgewise and thereby providing a dual necktie appearance similar to tie 20 of FIGS. 1 and 2 or tie 140 of FIGS. 8 and 9. Although dual tie 300 is not convertible into two separate neckties as in the first embodiment of FIGS. 1 and 2 or the fifth embodiment of FIGS. 8 and 9, it is reversible to provide the corollary styling to its opposite side.

Figure 30:
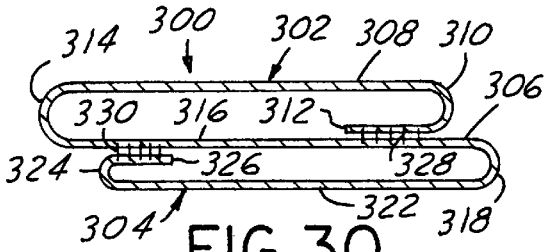
FIG. 30 is a simplified cross-sectional view taken on a line 30—30 of FIG. 29.
Figure 31:
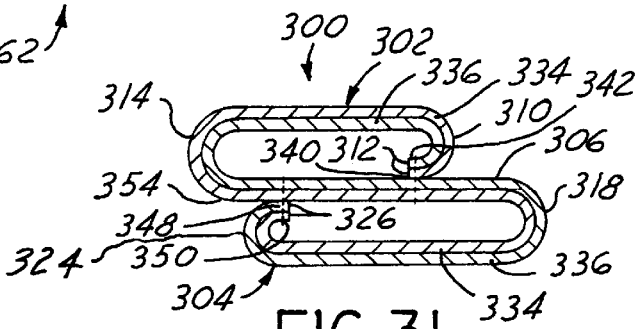
FIG. 31 is a simplified and diagrammatic cross-sectional illustration of the construction of FIGS. 29 and 30.
Figure 19:
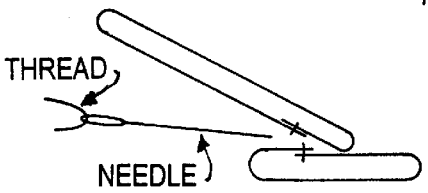
FIGS. 19, 20, 21 and 22 are simplified diagrammatic views illustrating steps shown in sequence of one manual mode of reversibility stitching for fastening the construction of for example, FIGS. 13–15.
Figure 20:
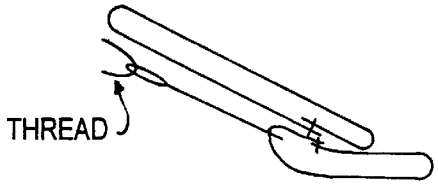
Figure 21:
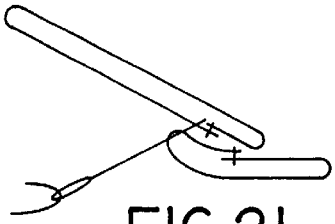
Figure 22:
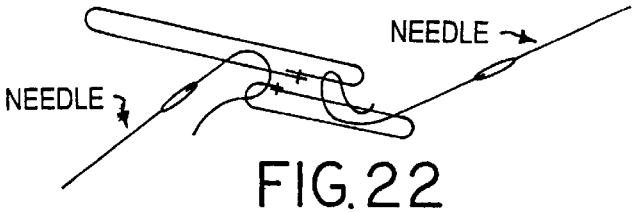
Figure 23:
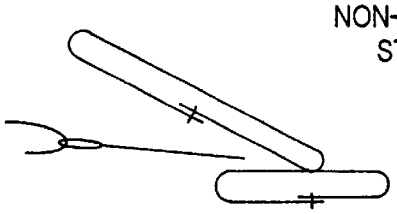
FIGS. 23–28 are simplified diagrammatic views in sequential order illustrating steps in one manual mode of stitching usable, for example, with a tie construction with the tie construction of FIG. 13.
Figure 24:
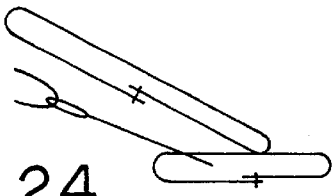
Figure 25:
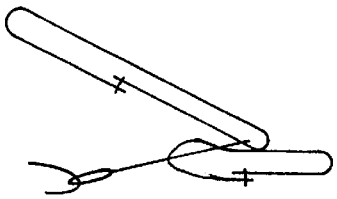
Figure 26:
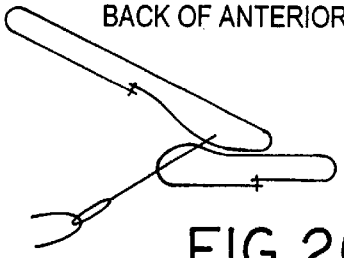
Figure 27:
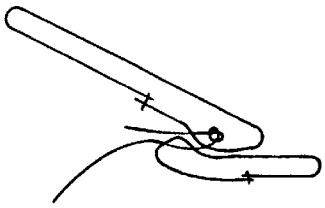
Figure 28:
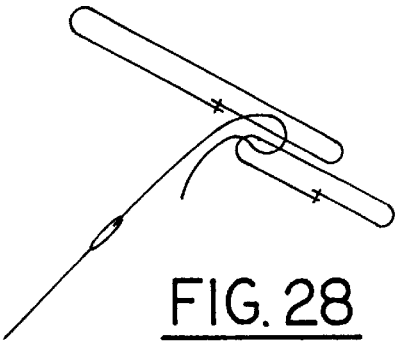

The construction of tie 300 is more particularly illustrated in FIGS. 30–34. FIG. 30 is a simplified cross-sectional view on the line 30—30 of FIG. 29 and therefore does 20 not indicate the dual layer laminate construction of tie 300 that is, instead, shown semi-schematically in FIG. 31. However, FIG. 30 does illustrate the manner in which a single piece of fabric laminate is folded back on itself to form two superimposed and slightly laterally offset loops to thereby construct the dual necktie 300. Note that what is designated as the anterior tie 302 presents an anterior surface 308 with a port side edge 310 formed by turning under the outer port side edge 312 of the initial fabric dual-ply laminate, made from two starting blanks of identical perimeter layout, so that edge 310 is actually a return longitudinal fold portion of the fabric laminate. The starboard side edge 314 of anterior tie 302 is also a U-shaped fold bend of the material to bring a fold panel 316 under and parallel to anterior fold panel 308.

Figure 34:
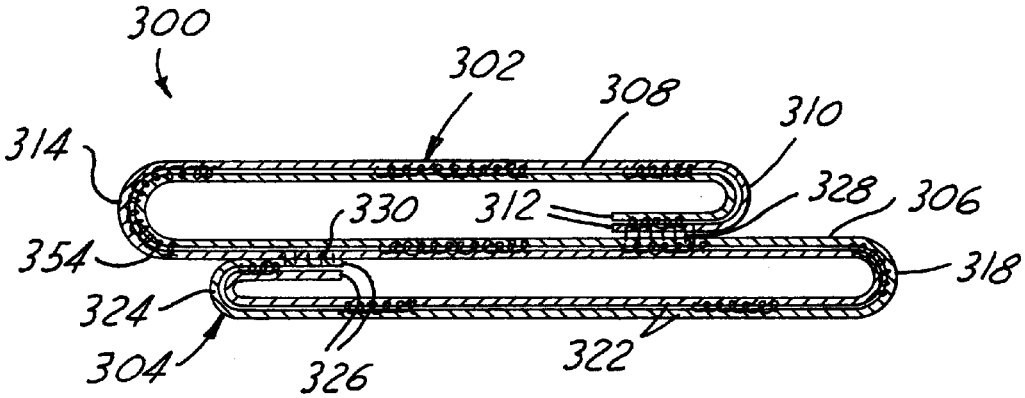

The port side edge 318 of posterior tie 304 is likewise a U-shaped return bend fold to bring another fold panel 322 of the dual laminate material back so as to overlie most of fold panel 316. The starboard edge 324 of posterior tie 304 is again a U-shaped return bend fold of fold panel 322 to thereby lay against fold panel 316 the initial or original starboard side edge 326 of the original fabric dual laminate starting blank. The folded-under port edge portion of anterior tie 302, i.e., that portion disposed between bend fold edge 310 and the starting blank port edge 312, is joined to fold panel 316 by a suitable line of stitching 328, Velcro or fastening snaps, as shown in FIGS. 30 and 34. Likewise, the folded-in return bend starboard edge portion of posterior tie 304, i.e., that portion disposed between bend fold edge 324 and blank edge 326, is stitched to the posterior surface of panel 316 of anterior tie 302 by a line of stitching 330 Velcro, or fastening snaps, as also shown schematically in FIGS. 30 and 34.

Figure 32:
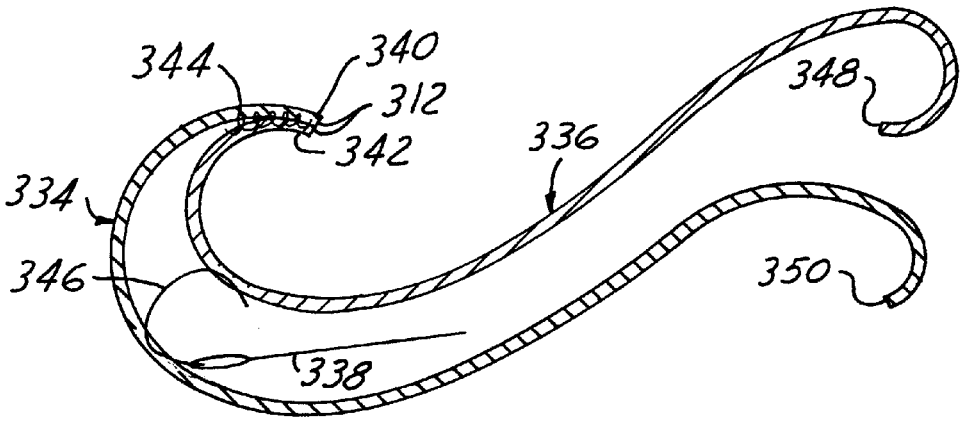
FIGS. 32, 33 and 34 are simplified semi-schematic diagrammatic cross-sectional views illustrating sequential steps in the construction of the ninth embodiment tie of FIGS. 29–31.

As best seen in FIGS. 31–34, dual tie 300 is formed by preparing a two-ply starting blank, one of the plies being designated by the reference numeral 334 in FIG. 32. Ply 334 is made of a material having a given distinct appearance, either due to its color, surface imprint, weave, pattern texture, knit, or other parameter affecting the appearance of the fabric. The other companion ply of the two-ply starting blank is designated by the reference numeral 336 in FIG. 32. Ply 336 is made of a fabric having a different one of the foregoing appearance parameters in order to distinguish it in appearance from that of blank ply 334. Again, this may be accomplished by its manner of construction, i.e. knit versus woven, the type of thread used in the construction, the color of the thread, the pattern woven into or imprinted onto the fabric, etc.

Figure 33:
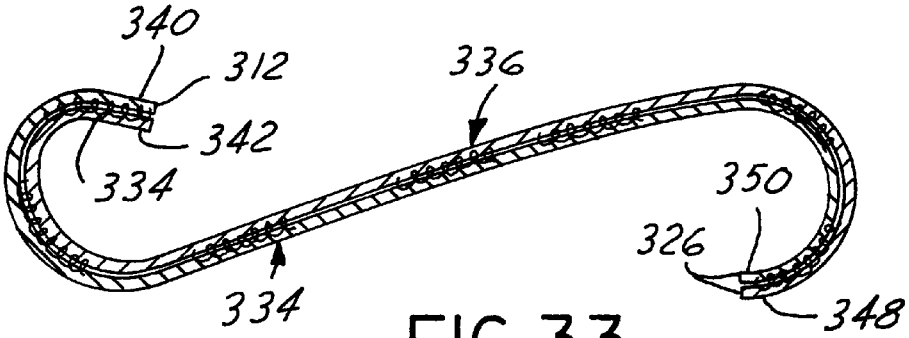

The dual ply laminate of blanks 334 and 336 is formed by overlying the two pieces of identical shape and size single ply starting blanks with their longitudinal edges 340 and 342 along one side laid flush in alignment to form the dual laminate finished edge 312. The facing surfaces of blanks 334 and 336 may be joined by suitable stitching indicated at 344 in FIG. 33, the forming of the stitching being indicated schematically by the needle 338 and thread 346 shown in FIG. 32. FIG. 33 illustrates the two starting blanks 334 and 336 completely joined together by the stitching, Velcro, or fastening snaps referenced in FIG. 32. Blank 336 is indicated in cross-section by cross-hatching, whereas blank 334 is indicated by parallel section lines. It will be seen that the blank ply side edges 348 and 350 of blanks 336 and 334 respectively that are shown unjoined in FIG. 32 have become joined and flush with one another to form the dual edge 326 that will be folded under to locate the edge 326 as shown in FIG. 34.

From the foregoing it will be seen that it will be seen that the dual necktie construction 300 is reversible so that, when reversed from the showing in FIG. 29, the portion designated as the posterior tie 304 is presented as the outward or anterior portion of tie 300 thereby presenting the material of blank 336 as the dominate appearance of the dual tie. When so reversed, the portion of blank 334 protruding laterally beyond the edge 324 (FIGS. 31 and 34) now forms an anterior facing decorative border edge designated by the numeral 354 in FIGS. 31 and 34.

It also will be seen from FIGS. 29–34 that the ninth embodiment dual necktie construction 300 provides a reversible dual necktie construction wherein each of the posterior and anterior tie portions is full size. The lay-up construction of joining two starting single-ply blanks of equal size and shape laid over one another so as to be flush at their edges provides an economical mode of construction. The two-ply weight throughout of tie 300 also eliminates the need for a separate conventional liner piece inasmuch as whichever laminate becomes the interior laminate in one of the two portions serves as a substitute for such liner by stiffening the tie, adding body and weight so that the lay of the tie is aesthetically pleasing.

From the foregoing description it now will be apparent to those of ordinary skill in the art that a dual necktie construction in accordance with the invention readily achieves all of the aforestated objects and provides many advantages both to the manufactures and to the purchaser of such dual ties. Additionally, those having an existing wardrobe of single conventional ties can now economically convert and expand their tie wardrobe by use of the dual tie assembly and fastener retrofit knit methods and constructions of the invention. The dual-tie construction of the invention offers a wide variety of creative design opportunities to the stylist, whether it be one employed by the manufacturer or the do-it-yourself owner of a wardrobe of conventional single ties. The invention also provides an unusual and novel appearance effect of two ties in one, and one in which the back or inner tie can compliment the appearance of the front or outer tie by way of contrast in any number of visible parameters, such as: (a) color, (b) pattern, (c) texture, (d) fabric, etc. For example in one working example of the forth embodiment of FIG. 7 and shown in the aforementioned photographs Nos. 1–5 attached as an appendix to the above-identified provisional application it is to be noted that the front tie is a rep stripe tie with one of the stripes being dark green, and the back tie is a solid color knit tie of dark green complemental to and harmonizing with the multi-color scheme of the rep stripes of the front tie.

It is also understood that the dual tie embodiments 20 and 100 can be constructed so that the inner tie 24 has its exposed border edge 34' converging with the adjacent border edge 36 of outer tie 22 so as to run flush therewith in the collar zone 28, similar to the construction of tie 130 in FIG. 7, thereby reducing the lateral width of the dual tie under the collar.

Also, a conventional single tie may be readily suitably shortened in overall length by cutting out a section in the collar region and reconnecting the cut tie section, as by stitching. This will enable the exposed edge of tip 74 of inner tie 24 to be assembled flush with the adjacent edge of tip 72 if it is desired to avoid a two-point-tip appearance in the dual tie construction.

It will also be evident to those skilled in the art, as well as to the ordinary user of four-in-hand ties, that the narrower width end portion of each single tie 22 and 24 in the first embodiment dual tie 20 (as well as in the remaining dual tie embodiments) will, as usual, remain hidden beneath the wider end section or portion of each tie or both ties as normally worn in use by the tie wearer. Thus, such narrow ends of tie 20 are not visible in the in-use showing of tie 20 in FIG. 1. Accordingly, when a dual tie of the invention is being constructed in accordance, for example, with the third embodiment of FIGS. 5 and 6, the inner narrower tie section or portion 116 may be omitted, if desired, to reduce manufacturing costs.

What is claimed is:

1. A dual four-in-hand necktie formed from at least a first single four-in-hand necktie having a wider dress first end portion and a longitudinally opposite narrower second end portion normally hidden beneath said first end portion as worn in use to thereby at least initially constitute, in a first user-worn orientation, a complete single four-in-hand tie, and further formed from a second tie having at least a first portion generally longitudinally dimensionally conforming to at least said first end portion of said first tie, said first tie being fastened along the length of at least its wider first end portion on a first exterior surface thereof to an exterior surface of said second tie, said first and second ties being constructed and arranged for alignment as so fastened in laterally overlapping and staggered off-set relationship with one of said ties outermost as worn and such that at least a first longitudinal edge of said exterior surface of said second tie is thereby exposed to view along an adjacent first longitudinal edge of at least said wider first end portion of said first tie in the first user-worn orientation as viewed by a frontal observer of the tie user-wearer, and the overlapping relationship of said ties as so fastened causes one longitudinal edge of one of said ties to be thereby hidden from such view by being covered by said outermost tie.

2. The dual necktie of claim 1 wherein each of said first and second single ties, at least initially prior to constituting said dual necktie, constitutes a complete four-in-hand tie individually usable and wearable as such, each of said ties having said wider and narrower first and second end portions and said ties each having a neckband portion longitudinally connecting together said end portions of its respective tie.

3. The dual necktie of claim 2 wherein said first and second ties are permanently fastened together by a line of stitching.

4. The dual necktie of claim 2 wherein said first and second ties include cooperable fastening means operable for detachably fastening said ties together so that said ties are separable by uncoupling said fastening means and then wearable as complete individual single four-in-hand ties.

5. The dual necktie of claim 4 wherein said fastening means comprise cooperable first and second snap fasteners secured respectively to said first and second ties and respectively spaced apart longitudinally of said first and second ties.

6. The dual necktie of claim 4 wherein said fastening means comprises cooperable hook and loop type plastic fastening materials respectively secured one to one of said ties and the other to the other of said ties.

7. The dual necktie of claim 2 wherein said first tie is of the woven fabric type and said second tie is of the tubular knit fabric type.

8. The dual necktie of claim 2 wherein said second tie has a predetermined length relative to said first tie such that an end termination of said wider first end portion of said second tie does not protrude visibly, to the aforementioned frontal observer, beyond an end termination of said wider first end portion of said first tie.

9. The dual necktie of claim 1 wherein said second tie first portion is longitudinally generally co-extensive only with said wider first end portion of said first tie.

10. The dual necktie of claim 9 wherein said second tie also comprises a narrower second end portion fastened to said first tie so as to be longitudinally generally co-extensive only with said narrower second end portion of said first tie.

11. The dual necktie of claim 10 wherein said first and second end portions of slid first tie are joined together by a neckband portion of said first tie, and wherein said first and second portions of said second tie have mutually juxtaposed end terminations spaced longitudinally apart generally by the length of said neckband so that said neckband does not generally overlie said second tie.

12. The dual necktie of claim 1 wherein said necktie is reversible in use such that when said dual necktie is reversed for wear in a second user-worn orientation, said second tie first portion overlies said first tie wider first end portion such that only one longitudinal edge of said first exterior surface of said first tie is thereby exposed to the view of the aforementioned frontal observer and the remainder of said first tie wider first portion is hidden from such view by being covered by said second tie first portion.

13. The reversible dual necktie of claim 12 wherein the mutually facing sides of said first and second ties are constructed in the conventional manner of constructing the posterior sides of single complete four-in-hand ties.

14. The dual necktie of claim 2 wherein said necktie is reversible in use such that when said dual necktie is reversed for wear in a second user-worn orientation, said second tie first portion overlies said first tie wider first end portion such that only one longitudinal edge of said exterior surface of said first tie is thereby exposed to the view of the aforementioned frontal observer and the remainder of said first tie wider first portion is hidden from such view by being covered by said second tie first portion.

15. The dual necktie of claim 14 wherein the mutually facing sides of said first and second ties are constructed in the conventional manner of constructing the posterior sides of single complete four-in-hand ties.

16. A method of constructing a reversible dual necktie comprising the steps of:

(1) providing a complete single four-in-hand type first necktie, (2) providing a complete single four-in-hand type second necktie, (3) providing releasable and cooperable first and second fastening means, (4) attaching said first fastening means to the posterior side of said first tie in predetermined locations, (5) attaching said second fastening means to the posterior side of said second tie in predetermined locations coordinated for coupling cooperation with said first fastening means, (6) assembling said first and second ties together by juxtaposing said posterior sides of said ties in mutually facing relation with said first and second fastening means mutually registered, and (7) coupling said first and second fastening means to thereby provide a dual reversible necktie.

17. The method of claim 16 wherein steps (4) and (5) are performed to orient said predetermined locations of said fastening means such that said first and second ties upon being coupled in step (7) are thereby aligned in laterally staggered off-set relationship such that one longitudinal edge of said posterior surface of said second tie is exposed to view along the adjacent longitudinal edge of said first tie by a frontal observer of the tie user-wear when said dual necktie is worn with said first tie outermost, and vice versa upon reversal.

18. The method of claim 17 wherein said first and second neckties provided in steps (1) and (2) each have a pointed end tip at each of the longitudinally opposite ends thereof, and wherein said fastener means orienting step is performed to cause said tips at said first and second ties to be arrayed side-by-side at each of the longitudinally opposite ends of said ties when assembled to provide said reversible dual neckties with frontally visible dual pointed end tips.

19. The method of claim 17 wherein steps (4) and (5) are performed to orient said predetermined locations of said fastening means such that said first and second ties upon being coupled in step (7) are thereby aligned in laterally staggered off-set relationship such that one longitudinal edge of said posterior surface of said second tie is exposed to view along the adjacent longitudinal edge of said first tie as viewed by a frontal observer of the tie user-wear when said dual necktie is worn with said first tie outermost, and vice versa upon reversal.

20. The method of claim 16 wherein steps (1) and (2) are performed by choosing the appearance parameters of color, pattern and fabric of each said ties so that the said neckties differ from one another with respect to each of said parameters but nevertheless harmonize in contrast as to said parameters to thereby create a novel but pleasing dual necktie styling effect.

21. The method of claim 17 wherein step (3) comprises providing hook and loop fastening means as said first and second fastening means in the form of a do-it-yourself fastener kit with instructions for utilizing the kit with ready-made first and second neckties for performing the method of claim 17.

22. A dual necktie formed from at least a first four-in-hand necktie having a wider dress first end portion and a longitudinally opposite narrower second end portion normally hidden beneath said first end portion as worn in use to thereby provide, in a first user-worn orientation, a complete four-in-hand tie, and further formed from a second tie having at least a portion at least generally longitudinally dimensionally conforming to at least said first end portion of said first tie, said first tie being fastened along the length of at least its wider first end portion on a first user-worn-orientation surface thereof to one surface of said second tie, said first and second ties being constructed and arranged for alignment as so fastened in laterally staggered off-set relationship such that at least one longitudinal edge of said second tie is thereby exposed to view along the adjacent longitudinal edge of at least said wider first end portion of said first tie in the first user-worn orientation as viewed by a frontal observer of the tie user-wearer.

23. The dual necktie of claim 22 wherein said first and second ties are permanently fastened together by stitching.

24. The dual necktie of claim 22 wherein said first and second ties include cooperable fastening means operable for detachably fastening said ties together so that said ties are separable by uncoupling said fastening means and then at least one of said ties is wearable as a complete individual single four-in-hand tie.

25. The dual necktie of claim 24 wherein said second tie first portion is longitudinally generally co-extensive only with said wider first end portion of said first tie.

26. The dual necktie of claim 22 wherein said dual necktie is constructed as a dual layer laminate of first and second starting blanks overlaid on one another and edgewise co-terminus, said blanks being longitudinally folded to form a first loop defining said first tie and a second loop defining said second tie; and wherein said necktie is reversible in use such that when said dual necktie is reversed for wear in a second user-worn orientation, said second loop overlies said first loop such that only one longitudinal edge of said first tie loop is thereby exposed to the view of the aforementioned frontal observer and the remainder of said first tie loop is hidden from such view by being covered by said second tie loop.

27. The dual necktie of claim 22 wherein said second tie comprises a laterally narrow strip of fabric tie material underlapping said adjacent longitudinal edge of said first tie and protruding laterally outwardly therefrom to form a border edge visible by the frontal observer of the tie user-wearer.

28. The dual necktie of claim 22 wherein said second tie comprises a strip of flat plane plastic material of substantially narrower lateral width than said first tie, and being fastened thereto along said longitudinal edge of said first tie.

29. The necktie of claim 28 wherein said plastic strip is fastened to the anterior surface of said first tie.

30. The necktie of claim 28 wherein said strip is fastened to the posterior side of said first tie.

31. The necktie of claim 22 wherein said first and second ties are formed from a single starting blank of a dual laminate material construction wherein the first laminate is distinguishable from a second laminate from the standpoint of an appearance parameter selected from the group consisting of color, pattern, weave, knit, fabric and texture, said first tie comprising a fold of the material lapped back upon itself and joined to a reverse return bend tucked-in edge, and said second tie comprises a continuation of said folded back portion of said first tie out to a return bend and then back underlapping the first tie to a second return bend of the other edge of said blank that is tucked in and joined to said backlap of said first tie.

32. A method of constructing a dual necktie comprising the steps of:

(1) providing a complete single four-in-hand type first necktie, (2) providing a second necktie having an appearance different than said first tie, (3) providing cooperable first and second fastening means, (4) attaching said first fastening means to said first tie in predetermined locations.

(5) attaching said second fastening means to said second tie in predetermined locations coordinated for coupling cooperation with said first fastening means, (6) assembling said first and second ties together by juxtaposing said ties in mutually facing relation and oriented with said first and second fastening means adapted to be mutually registered, and (7) coupling together said neckties with interengagement of said first and second fastening means to thereby provide a dual necktie with said second tie forming s contrasting border along one longitudinal edge of said first tie.

33. The method of claim 32 wherein steps (4) and (5) are performed to orient said predetermined locations of said fastening means such that said first and second ties upon being coupled in step (7) are thereby aligned in laterally staggered off-set relationship such that at least one longitudinal edge of said second tie is exposed to view along the adjacent longitudinal edge of said first tie by a frontal observer of the tie user-wear when said dual necktie is worn with said first tie outermost.

34. The method of claim 32 wherein steps (1) and (2) are performed by choosing the appearance parameters of color, pattern and fabric of each said ties so that the said neckties differ from one another with respect to each of said parameters but nevertheless harmonize in contrast as to said parameters to thereby create a novel but pleasing dual necktie styling effect.

* * * * *